US007898493B1

(12) United States Patent
Rojas et al.

(10) Patent No.: US 7,898,493 B1
(45) Date of Patent: Mar. 1, 2011

(54) IMPLEMENTATION OF ULTRA WIDE BAND (UWB) ELECTRICALLY SMALL ANTENNAS BY MEANS OF DISTRIBUTED NON FOSTER LOADING

(75) Inventors: Roberto G. Rojas, Upper Arlington, OH (US); Bryan D. Raines, Columbus, OH (US); Khaled A. Obeidat, Columbus, OH (US)

(73) Assignee: The Ohio State University, Columbus, OH (US)

( * ) Notice: Subject to any disclaimer, the term of this patent is extended or adjusted under 35 U.S.C. 154(b) by 340 days.

(21) Appl. No.: 12/139,424

(22) Filed: Jun. 13, 2008

Related U.S. Application Data

(60) Provisional application No. 60/943,776, filed on Jun. 13, 2007.

(51) Int. Cl.
*H01Q 1/50* (2006.01)

(52) U.S. Cl. ..... 343/850; 343/860

(58) Field of Classification Search ..... 343/850, 343/860
See application file for complete search history.

(56) References Cited

U.S. PATENT DOCUMENTS

| | | | | |
|---|---|---|---|---|
| 3,716,867 | A | 2/1973 | Mayes et al. | |
| 6,121,940 | A * | 9/2000 | Skahill et al. | 343/860 |
| 6,509,875 | B1 | 1/2003 | Nair et al. | |
| 7,123,198 | B2 | 10/2006 | Svigelj et al. | |

OTHER PUBLICATIONS

Best, S.R., The Radiation Properties of Electrically Small Folded Spherical Helix Antennas, IEEE Transactions on Antennas and Propagation, Apr. 2004, pp. 953-960, vol. 52, No. 4.

Di Nallo, C. et al., Wideband Antenna using non-Foster Loading Elements, IEEE, 2007, pp. 4501-4504.

Garbacz, R.J., Modal Expansions for Resonance Scattering Phenomena, Proceedings of the IEEE, Aug. 1965, pp. 856-864.

Hansen, R.C., Wideband Dipole Arrays Using Non-Foster Coupling, Microwave and Optical Technology Letters, Sep. 20, 2003, pp. 453-455, vol. 38, No. 6.

Harrington, R.F. et al., Theory of Characteristic Modes for Conducting Bodies, IEEE Transactions on Antennas and Propagation, Sep. 1971, pp. 622-628, vol. AP-19, No. 5.

Harrington, R.F. et al., Computation of Characteristic Modes for Conducting Bodies, IEEE Transactions on Antennas and Propagation, Sep. 1971, pp. 629-639, vol. AP-19, No. 5.

Harrington, R.F. et al., Control of Radar Scattering by Reactive Loading, IEEE Transactions on Antennas and Propagation, Jul. 1972, pp. 446-454, vol. AP-20, No. 4.

Harrington, R.F. et al., Pattern Synthesis for Loaded N-Port Scatterers, IEEE Transactions on Antennas and Propagation, Mar. 1974, pp. 184-190, vol. AP-22, No. 2.

Mautz, J.R. et al., Modal Analysis of Loaded N-Port Scatterers, IEEE Transactions on Antennas and Propagation, Mar. 1973, pp. 188-199, vol. AP-21, No. 2.

(Continued)

*Primary Examiner* — Hoang V Nguyen
(74) *Attorney, Agent, or Firm* — Standley Law Group LLP

(57) ABSTRACT

A method to design antennas with broadband characteristics. In an exemplary embodiment, a method comprises loading an antenna structure with multiple reactive loads. The multiple loads are synthesized by applying the theory of Characteristic Modes. Another exemplary embodiment includes an antenna adapted to have broadband characteristics. One example is a wire dipole antenna. In an exemplary embodiment, a loaded antenna may be adapted to resonate an arbitrary current over a wide frequency band. The loads may require non-Foster elements when realized. Exemplary embodiments may include the broadband characteristics of the both the input impedance at the terminal of the antenna as well as the radiation pattern.

21 Claims, 22 Drawing Sheets

OTHER PUBLICATIONS

Newman, E.H., The Electromagnetic Surface Patch Code: Version 5.4, Mar. 18, 2006, 2 pages, The Ohio State University, [online] http://esl.eng.ohio-state.edu/.

Poggio, A.J. et al., Bandwidth Extension for Dipole Antennas by Conjugate Reactance Loading, IEEE Transactions on Antennas and Propagation, Jul. 1971, pp. 544-547.

Quirin, J.D., A Study of High-Frequency Solid-State Negative-Impedance Converters for Impedance Loading of Dipole Antennas, Master's Thesis, 1970, 89 pages, University of Illinois at Urbana-Champaign.

Sussman-Fort, S.E., Matching Network Design Using Non-Foster Impedances, International Journal of RF and Microwave Computer-Aided Engineering, 2006, pp. 135-142, vol. 16, No. 2.

Yaghjian, A.D. et al., Impedance, Bandwidth, and Q of Antennas, IEEE Transactions on Antennas and Propagation, Apr. 2005, pp. 1298-1324, vol. 53, No. 4.

* cited by examiner

IMPLEMENTATION OF ULTRA WIDE BAND (UWB) ELECTRICALLY SMALL ANTENNAS BY MEANS OF DISTRIBUTED NON FOSTER LOADING

This application claims the benefit of U.S. Provisional Application No. 60/943,776, filed Jun. 13, 2007, which is hereby incorporated by reference in its entirety.

BACKGROUND AND SUMMARY OF THE INVENTION

To obtain a wide band antenna design in an exemplary embodiment of the present invention, a relatively constant pattern and impedance over the desired frequency range may be achieved. Both of these aspects are essentially dependent on the antenna current, which implies a relatively constant current distribution over the desired frequency range. Generally, there are two underlying design goals in an exemplary embodiment of the present invention. The first goal is to preserve a relatively constant current distribution along the antenna over the desired frequency range to achieve broad bandwidth in terms of pattern. The second goal is to keep the current magnitude and phase at the feeding port nearly constant over the frequency band to achieve a wide input impedance bandwidth. Broadband behavior may therefore be obtained by shaping the antenna current distribution over frequency, using several techniques.

Broadband antenna design may comprise two aspects: relatively constant pattern and impedance over frequency. Both of these aspects are essentially dependent on the antenna current, which implies a relatively constant current distribution over frequency. Broadband behavior may therefore be obtained by shaping this current distribution over frequency, using several techniques. The theory of characteristic modes allows for the analysis and synthesis of antenna currents.

$$[X][I]=\lambda[R][I]$$

Known work involving characteristic modes has also involved pattern synthesis. In the known art, a method is provided by which any real current could be resonated given that the antenna was properly loaded with reactive elements. Thus at single frequencies, an antenna could be made to have an arbitrary pattern, provided that the current distribution which generated such a pattern is known. Also, the known art touched on the problem of bandwidth. However, the frequency behavior of the loads has not been discussed yet in the known art. Current research by the present inventors will show that the practical implementation of the loads over a wide frequency bank requires special consideration.

In order to apply characteristic mode theory to the development of broadband wire antennas, such frequency behavior must first be understood and the implications need to be considered. Therefore, simple wire antennas were analyzed using the Method of Moments. Then characteristic mode theory was applied over multiple frequencies to synthesize desired current distributions. In exemplary embodiments of the present invention, antennas show broadband behavior in both impedance and pattern.

Exemplary embodiments of the present invention include methods for designing an antenna as well as the resulting antenna. In one example, a method for designing an antenna is comprised of the following steps: 1) determining a desired current distribution over an antenna; 2) determining a number and location of at least one port over the antenna; 3) determining at least one desired load to achieve the desired current distribution; 4) providing at least one desired load with at least one lumped Foster or non-Foster circuit elements; and 5) determining current and radiation patterns over a desired frequency band. Other exemplary embodiments of the present invention may include one or more of such steps or various combinations or orders of such steps, which will be evident based on the present specification.

In the foregoing example, the step of determining the desired current distribution may be based on a desired radiation pattern and input impedance. For example, the step of determining the desired current distribution may enable a substantially constant radiation pattern and input impedance over a wider frequency band in comparison to a conventional electrically small to mid-size antenna. As further examples: 1) the step of determining the number and location of at least one port over the antenna may comprise determining the number and location of at least one port to sufficiently control the desired current distribution; 2) the step of determining at least one desired load to achieve the desired current distribution may comprise using Characteristic Mode Theory to compute at least one desired load sufficient to resonate the desired current distribution at least one port over the desired frequency band; 3) the step of providing at least one desired load with at least one lumped Foster or non-Foster circuit elements may comprise providing at least one desired load with at least one lumped Foster or non-Foster circuit elements over the desired frequency band; and 4) the step of determining the current and the radiation patterns over the desired frequency band may comprise determining input impedance over the desired frequency band. In addition, an exemplary method may further comprise the step of modifying the number and the location of at least one load until the desired current and radiation patterns are achieved. For example, the step of modifying the number and the location of at least one load until the desired current and radiation patterns are achieved may comprise the steps of adjusting the number and the location of at least one port and repeating the following steps until the desired current and radiation patterns are achieved: 1) determining at least one desired load to achieve the desired current distribution; 2) providing at least one load with at least one lumped Foster or non-Foster circuit elements; and 3) determining the current and radiation patterns over the desired frequency band.

In another exemplary embodiment of the present invention, an antenna may comprise at least one port; and at least one desired load with at least one lumped Foster or non-Foster circuit elements. In such an embodiment, the antenna may be adapted to provide a substantially constant radiation pattern and input impedance over a wide frequency band. An example of such antenna may be a wideband (e.g., ultrawideband) antenna. Furthermore, an exemplary embodiment of such antenna may be in a size range of electrically small to mid-size. Other variations may be possible.

Exemplary embodiments of the present invention may provide or enable various advantages or benefits. For instance, exemplary embodiments of the present invention may offer two innovations, namely, a method to design wideband antennas and the use of non-Foster components to load an antenna. In an exemplary embodiment, these components may provide additional degrees of freedom not available with known passive capacitors, inductors, and resistors. For example, in an exemplary embodiment of the present invention, the theory of Characteristic Mode (CM) may be used to load electrically small to mid-size antennas with non-Foster elements (e.g., negative valued capacitors and inductors) to force an antenna to preserve a fairly constant radiation pattern and input impedance over a wider frequency band. Furthermore, such loading may lower the Q factor of the antenna allowing a much higher bandwidth of operation than what conventional antennas can achieve if complemented with a passive matching network. Unlike conventional methods, an example of this method may allow for controlling both the pattern and impedance bandwidth loading of the antenna structure with Non-Foster components. The design of these loads may be done with the Method of Characteristic Modes. In contrast to exemplary embodiments of the present invention, other loading techniques of the known art do not generally work for electrically small to mid-size antennas. In particular, most wideband antennas are designed by choosing a geometry for the antenna and by adding dielectric, magnetic, or other exotic materials that usually have some loss.

Various other benefits or advantages of exemplary embodiments of the present invention may include one or more of the following: 1) easy retrofit with existing infrastructure, as added active loads may work with existing antennas; 2) using loads, the antenna current shape (and pattern shape) may be controlled over a desired band; 3) loaded antennas may be operated with less complex matching networks; 4) may be utilized in building an integrated antenna (e.g., on chip Technology—in other words, compatible with VLSI technology); and 5) may be no need to use exotic materials with hard to obtain electrical properties to achieve UWB antennas.

As a result of one or more of the aforementioned benefits, applications may include, but are not limited to, any UWB small antennas—including antennas for commercial, medical, homeland security, RFID, and other applications where electrically small integrated antennas may be useful or required. Other suitable applications include, but are not limited to, applications where wideband on-chip antennas are useful or required.

In addition to the novel features and advantages mentioned above, other benefits will be readily apparent from the following descriptions of the drawings and exemplary embodiments.

BRIEF DESCRIPTION OF THE DRAWINGS

FIG. 16(*a*) is a graph of an example of primary mode at 295 MHz.

FIG. 16(*b*) is a graph of an example of total current at 295 MHz.

FIG. 16(*c*) is a graph of an example of primary modes at 143 MHz.

FIG. 16(*d*) is a graph of an example of total current at 143 MHZ.

FIG. 16(*e*) is a graph of an example of primary modes at 160 MHz.

FIG. 16(*f*) is a graph of an example of primary+higher order modes at 160 MHz.

FIG. 16(*g*) is a graph of an example of total current at 160 MHz.

DETAILED DESCRIPTION OF EXEMPLARY EMBODIMENT(S)

Figure 1:
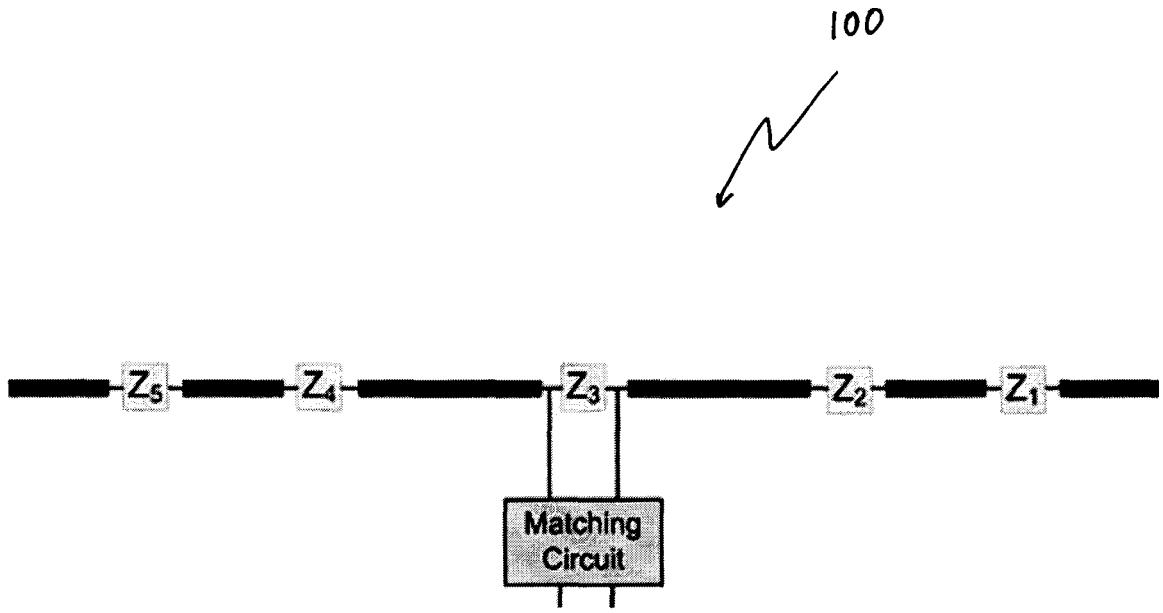
FIG. 1 is a schematic diagram of an exemplary embodiment of a loaded dipole antenna with multiple load circuits and a matching network at the feed point.

Exemplary embodiments of the present invention are directed to antennas and associated methods for designing antennas. To explore these techniques, a brief background on the relevant elements of characteristic mode theory is provided.

The theory of characteristic modes allows for analysis and synthesis of antenna currents. Characteristic modes are found from the following complex eigenvalue problem:

$$[Z_a]T_n=(1+j\lambda_n)[R_a]T_n \tag{1}$$

where $[Z_a]=[R_a]+j\,[X_a]$ is the N-port open circuit impedance matrix of the antenna, $T_n$ is the n-th eigencurrent, and $\lambda_n$ is the corresponding n-th eigenmode. This problem is obviously concerned with examining the relationship between the real and imaginary parts of the N-port open circuit impedance matrix. Implied in (1) are N characteristic modes, or N eigenmodes. The characteristic modes of an N-port loaded antenna are defined by as:

$$[X_a]T_n=\lambda_n[R_a]T_n. \tag{2}$$

The total current is therefore a weighted summation of all these modes:

$$\bar{I} = -\sum_{n=1}^{N} \frac{\bar{I}_n^* \bar{V}_{oc}}{1 + j\lambda_n} \bar{I}_n, \tag{3}$$

where $\bar{V}_{oc}$ is the N-port open circuit voltage column vector of the N-port network characterized by $[Z_a]$.

Generally, an eigenmode is termed dominant when the magnitude of its associated eigenvalue is small relative to the other modes. It is necessary to also stipulate that when an eigenmode is dominant, the other eigenvalues are large in magnitude (i.e. much larger than 1).

A. Reactive Loading

The eigencurrent (mode current) $T_n$ is in resonance when its corresponding eigenvalue $\lambda_n$ equals zero. In this case, the reactive power $\bar{I}_n^*[X_\alpha]\bar{I}_n$ is equal to zero, and thus, the eigencurrent is said to be in phase with the voltage source. In order to resonate any real (or equiphase) current $T_d$, the quantity $[X_a]T_d$ should be zero. By adding reactive loads, as described by the load matrix $[X_L]$, we can force that quantity to be zero: $[X_a+X_L]T_d=0$. Note that because the current $T_d$ will effectively become a characteristic mode of the loaded antenna with $\lambda_d=0$, $T_d$ must be real or at least equiphase. Furthermore, we are free to structure $[X_L]$ however we choose, as only the quantity $[X_L]T_d$ is needed to cancel $[X_a]T_d$. As suggested in the known art, $[X_L]$ may be determined to be diagonal (i.e., the antenna ports may be reactively loaded with one-port devices). Given these restrictions on $[X_L]$, the load matrix is uniquely determined by $$X_{L_i} = -\frac{1}{I_i}([X_\alpha]I_d)_i \tag{4}$$

where the subscript i denotes the $i^{th}$ port. References in the known art describe reactive loading in more detail.

B. Current Distribution Design

It is evident from (4) that the load matrix $[X_L]$ depends on the exact current distribution $T_d$. In some sense, the current is arbitrary, but it will obviously affect the antenna input impedance and pattern. For example, the current may provide "good" input impedance, which implies that it is not close to zero (in magnitude) at the feed port. For a wire dipole antenna with an omnidirectional pattern, an exemplary embodiment of an ideal current distribution is roughly the same as the current distribution of the eigencurrent that resonates at $\lambda/2$. The current may also maintain its shape over a wide frequency band, implying a constant pattern over the same wide frequency band. Currents that can satisfy these requirements are the so called Q-mode currents:

$$[\omega X'_\alpha]\bar{I}_n = Q_n[R_\alpha]\bar{I}_n, \tag{5}$$

where $[X'_a]$ is the frequency derivative of $[X_a]$, and $T_d$ is the n-th Q-mode current.

By selecting the smallest Q-mode and its associated eigencurrent from (5), broadband current behavior may be obtained, since that mode represents a current which yields the slowest-varying (relative to the other Q mode currents) reactances at all ports. Notice, however, that Q-mode currents are defined for a particular frequency. To obtain better low-frequency performance in an exemplary embodiment, the Q-mode current may be computed at the lower end of the desired frequency band as the overall antenna Q will naturally decrease for larger frequencies.

C. Overall Concept

The first step in the implementation of this proposed scheme is to determine the smallest Q-mode current as described by (5). Let us refer to this current as $T_d$. One key concept of an exemplary embodiment of the present invention is to maintain the same real (assumed for simplicity, as the current could also be equiphase) current distribution $T_d$ at each frequency in the specified frequency band such that the antenna pattern is constant and the input impedance is real over that band. By continuously forcing a real current on the surface of the antenna (by loading the antenna as prescribed in (4), a low Q, electrically small antenna can be achieved. This technique works well with such electrically small antennas, since only one dominant eigenmode is usually excited. In other words, the remaining eigenmodes are large over the frequency band, and thus from (3), the total current is dominated by the shape of $T_d$ with corresponding eigenmode $\lambda_d$ (i.e., the desired mode is dominant). Ideally, this eigenmode is equal to zero (i.e., the current $T_d$ is resonating). In an exemplary embodiment, the reactances suggested by $[X_L]$ may be implemented by a set of lumped circuit elements. These load circuits may invariably yield loads that are slightly different from the ideal $[X_L]$ (in general, only infinitely complex load circuits would be able to reproduce $[X_L]$ exactly), implying that the desired eigenmode $\lambda_d$ will be nonzero but still very small.

Another key concept of an exemplary embodiment is the determination of the nature of the reactive elements needed to implement the diagonal matrix $[X_L]$. It will be shown that non-Foster loading in an exemplary embodiment of the present invention achieves resonance of a desired current over a large frequency band.

III. EXAMPLES

Examples of the present invention include design methods that may applicable to any antenna shape. For simplicity, one example of a wire dipole antenna 100 of length 1.4 m and 1 mm radius is considered, as illustrated in FIG. 1. The antenna is segmented into several segments which gives reliable MoM results over the desired frequency band. In one example, a MoM code ESP5.4 may be used. Using (5), the lowest Q-mode current at 50 MHz to be resonated may be determined using (4). In this example, five ports were selected, with four ports distributed at different points along the dipole (the load ports) and one port at the feed point. In other examples, at least one port may be selected. The locations of the load ports may be chosen such that most of the ports are in regions where the currents are high (in this example, close to the feed point) and the remaining loads distributed along the rest of the antenna. The idea in this example is that the load ports near the feed point will stabilize the input impedance at the feed point, thereby lowering the requirements on a matching network placed at the feed. Choosing more ports along the dipole may give better control over the current shape along the dipole, but may naturally require more load circuits, thereby increasing antenna cost and complexity.

Figure 2:
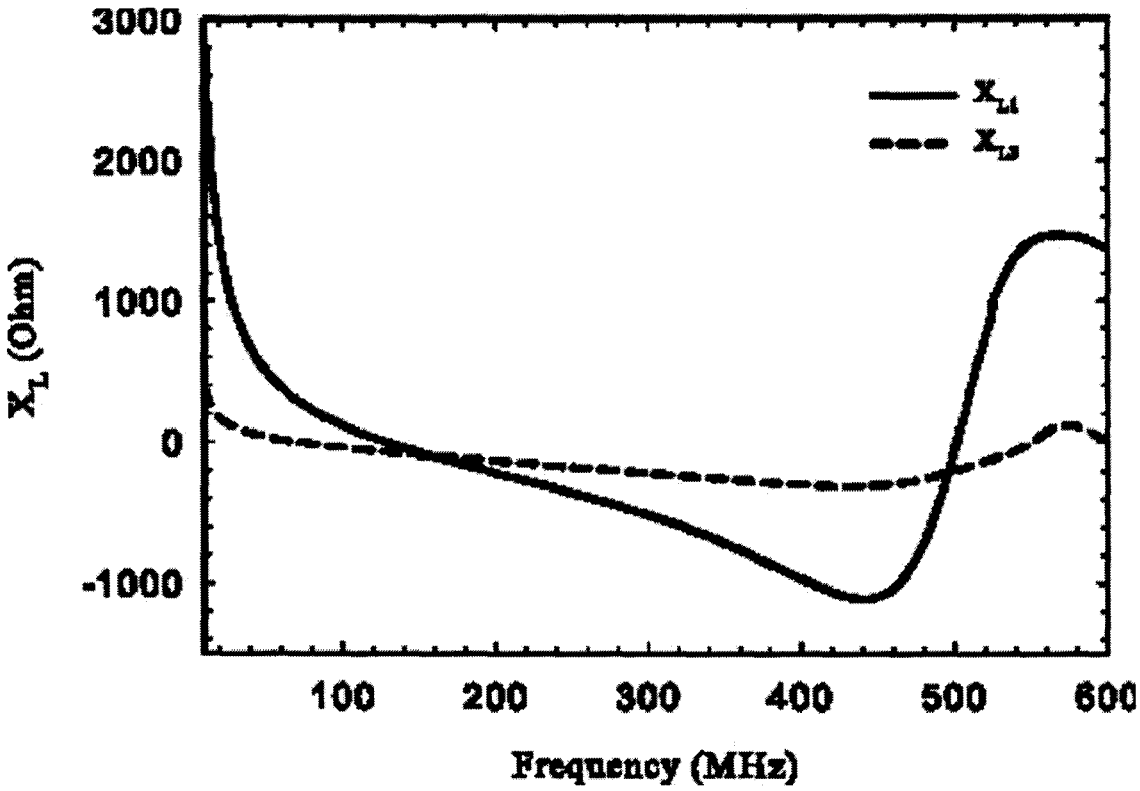
FIG. 2 is a graph of an example of required reactances (as specified by $[X_L]$ at ports 1 (near the end of the dipole) and 2 (near the center of the dipole).

Unless otherwise noted, the results in this section have been computed for three examples, each without a matching network at the feed port: perfect loading, approximate loading, and no loading. In the perfect loading case, the exact reactances in $[X_L]$ are used (therefore assuming an infinitely complex matching network at each load port). Two of the diagonal entries in $[X_L]$ are plotted versus frequency in FIG. 2. In the approximate loading case, the reactance $[X_L]$ at each port is approximated by a finite number of lumped elements. After examining the reactances required by the matrix $[X_L]$ (for this particular example) in one example, it was found that the reactance at each port may be satisfactorily approximated by a series LC circuit where both elements (L and C) have negative values (i.e., non-Foster circuits), as shown in Table I. Naturally, the no loading example describes the dipole antenna without loads (i.e., it only has a single port at the feed point). It is provided as a reference to demonstrate the improvements offered by this design technique.

TABLE I

LOAD REACTANCE VALUES OF THE LOADED 5 PORT DIPOLE ANTENNA

| Position (cm) | 0 | ±8.6 | ±34.3 |
|---|---|---|---|
| L (nH) | −120.19 | −327.46 | −207.87 |
| C (pF) | −14.78 | −4.97 | −9.69 |

Figure 3:
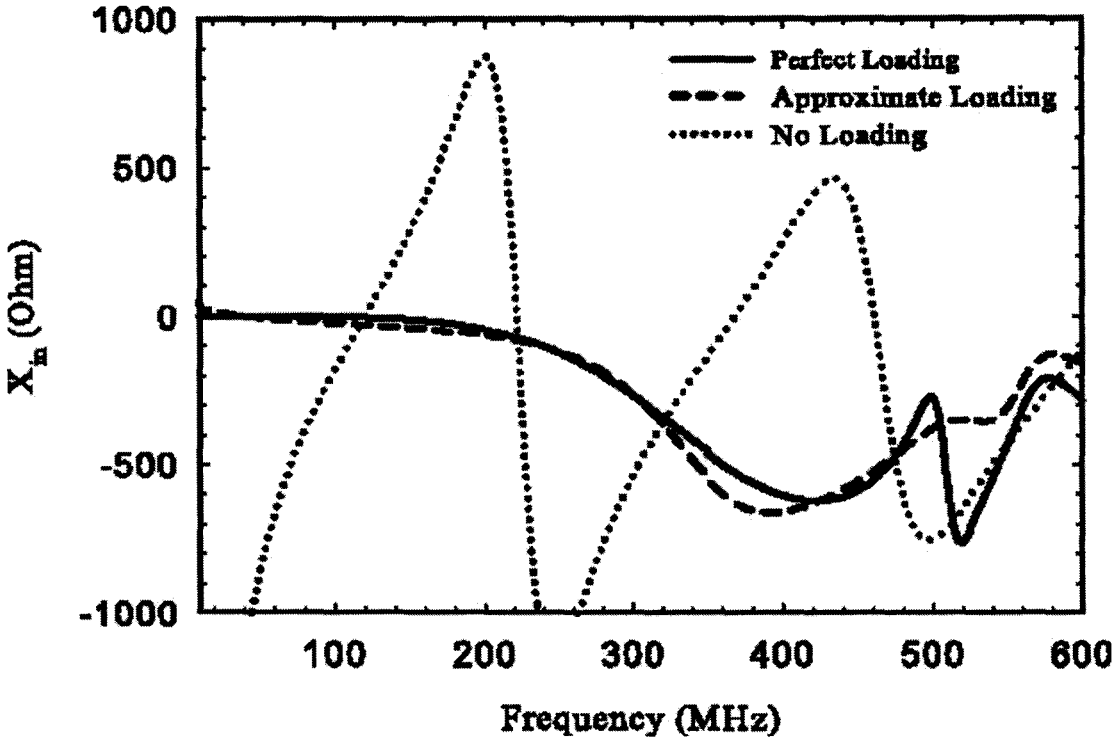
FIG. 3 is a graph of an example of input reactances $X_{in}$ at the feed port of the dipole antenna using prefer loading, approximate loading, and no loading.
Figure 4:
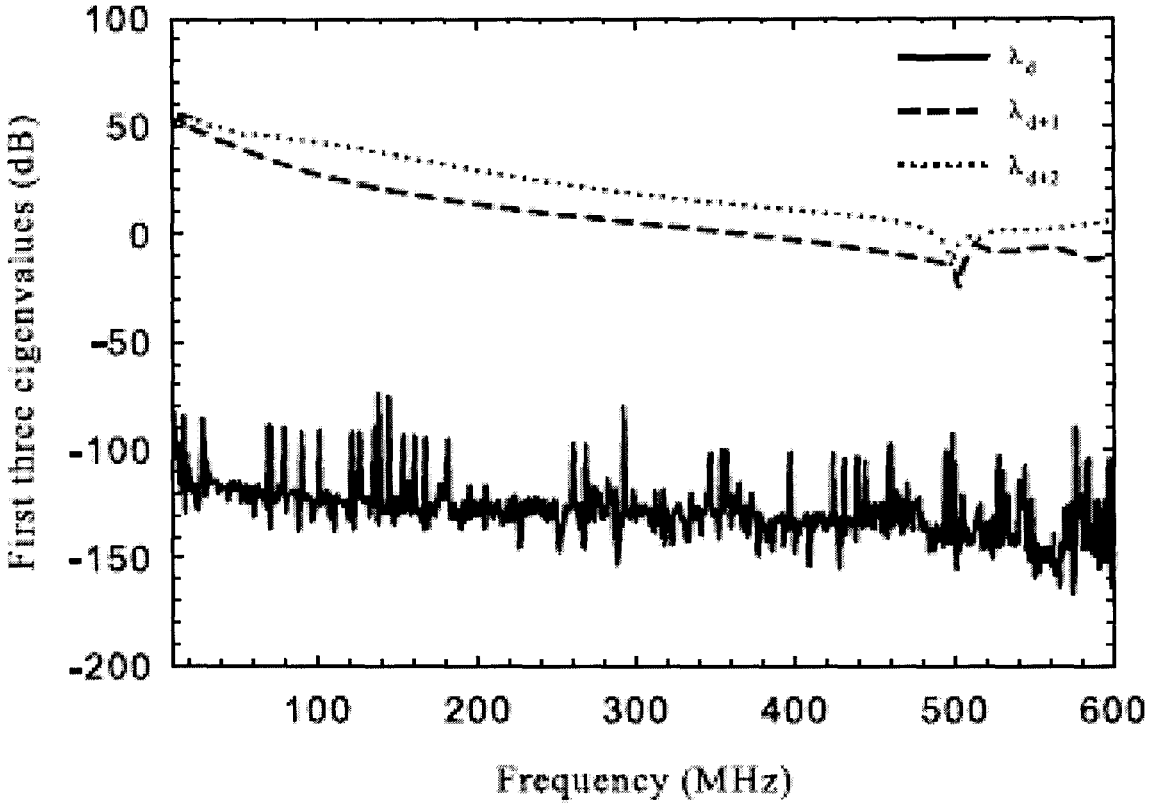
FIG. 4 is a graph of an example of values (dB) of the first three dominant modes of the dipole antenna using perfect loading. The feed port is also loaded with the reactance specified by $[X_L]$ (i.e., load $X_3$ in FIG. 1)).

The value of the input reactance at the feed port ($X_{in}$) with and without loading is shown in FIG. 3. The proposed technique in this example ensures a nearly resistive feed point input impedance when the higher order modes are very weakly excited ($|\lambda_i|>>|\lambda_d|$, $i\neq d$). However, as the frequency becomes higher, the electrical size of the antenna increases, which tends to excite higher order modes alongside the desired mode ($\lambda_d=0$). The next two eigenvalues corresponding to $\lambda_{d+1}$ and $\lambda_{d+2}$ are shown in FIG. 4. Note that these two eigenvalues become smaller, and therefore, the modes become more significant in the total current as the frequency increases. Consequently, the total current T, as determined by (4), will not satisfy $[X_a+X_L]T=0$ at high frequencies. This implies a non-zero reactance at the feed port at high frequencies. Further note that the example when the loads are exactly implemented results in the best possible frequency bandwidth performance for a given number and position of the loads, implying that the higher order modes in the approximate loading case become slightly more significant at lower frequencies compared to the perfect loading case. For the approximate load implementation case, the reactance at the feed port is non-zero (but small) for most frequencies.

Figure 5:
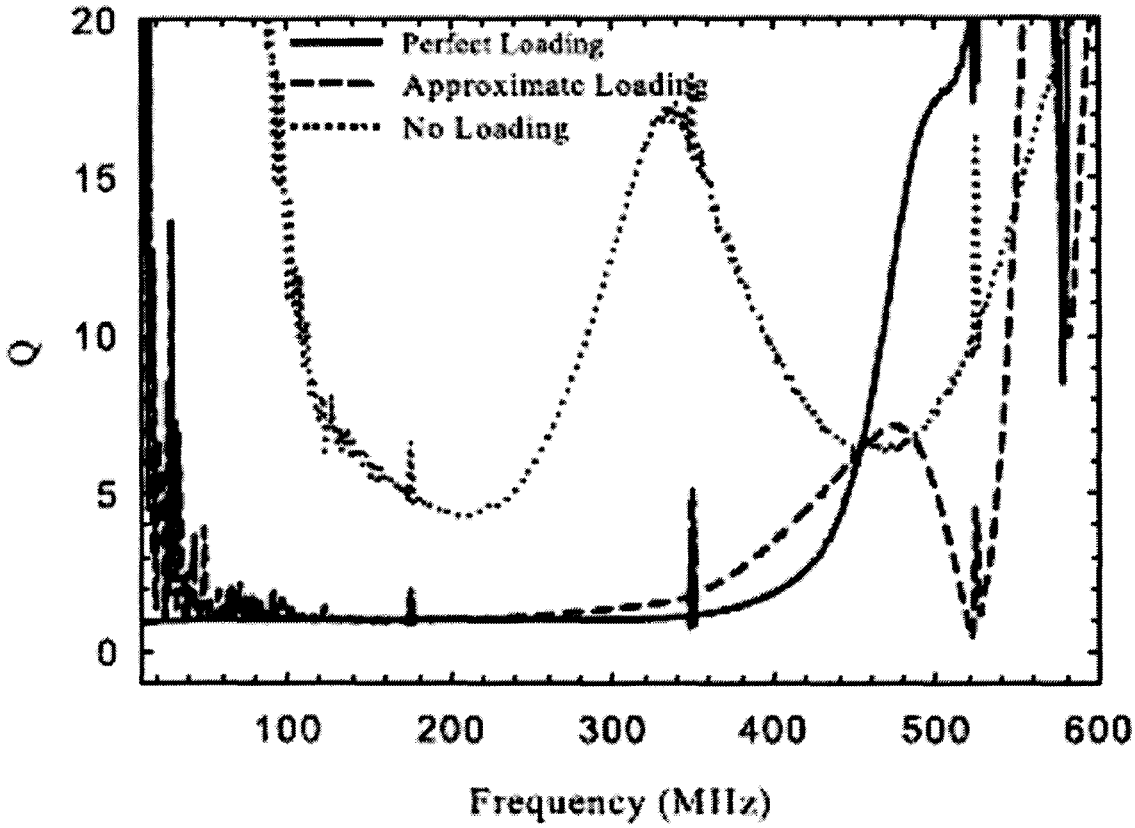
FIG. 5 is a graph of an example of the Q factor of the dipole antenna using perfect loading, approximate loading, and no loading.
Figure 6:
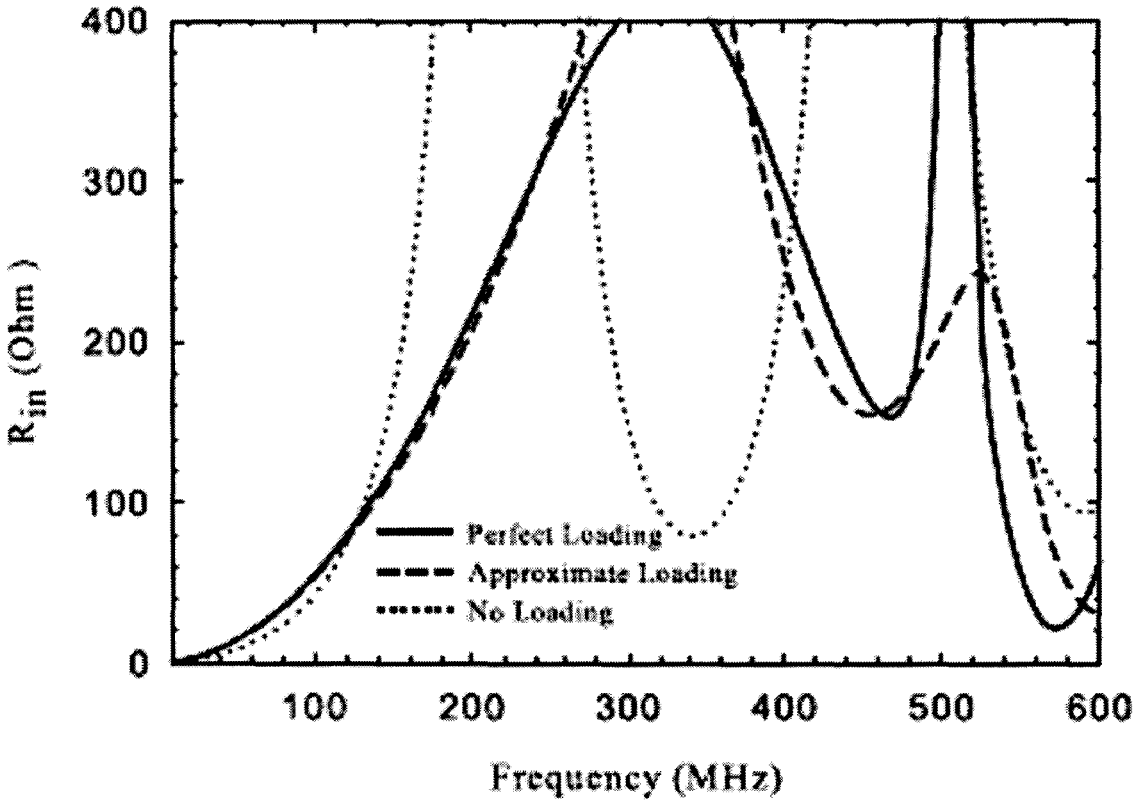
FIG. 6 is a graph of an example of the feed port input resistance $R_{in}$ of the dipole antenna using perfect loading, approximate loading, and no loading.

To measure the potential bandwidth of the antenna, Q factor may be extracted from the feed point input impedance by means of the following expression $$Q \approx \frac{\omega}{2R_{in}}\sqrt{\left(\frac{dR_{in}}{d\omega}\right)^2+\left(\frac{dX_{in}}{d\omega}+\frac{|X_{in}|}{\omega}\right)^2}, \tag{6}$$

where $R_{in}$ and $X_{in}$ are the antenna's frequency-dependent feedpoint resistance and reactance, respectively. The calculated Q of this example is shown in FIG. 5. It is evident that by forcing $X_{in}$ to be small and constant, a small Q factor may be achieved as long as the value of $R_{in}$, shown in FIG. 6 is not very small (i.e., larger than 10).

Figure 7:
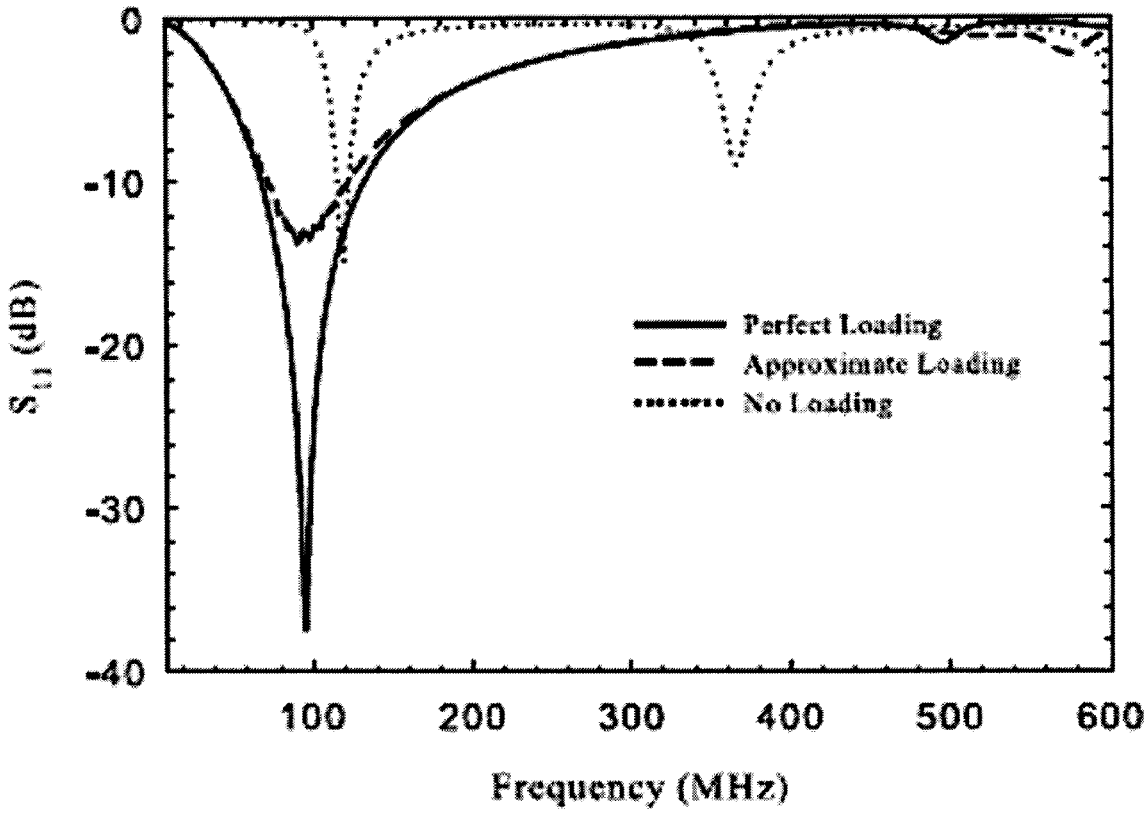
FIG. 7 is a graph of an example of the return loss $S_{11}$ of the dipole antenna using perfect loading, approximate loading, and no loading.
Figure 8:
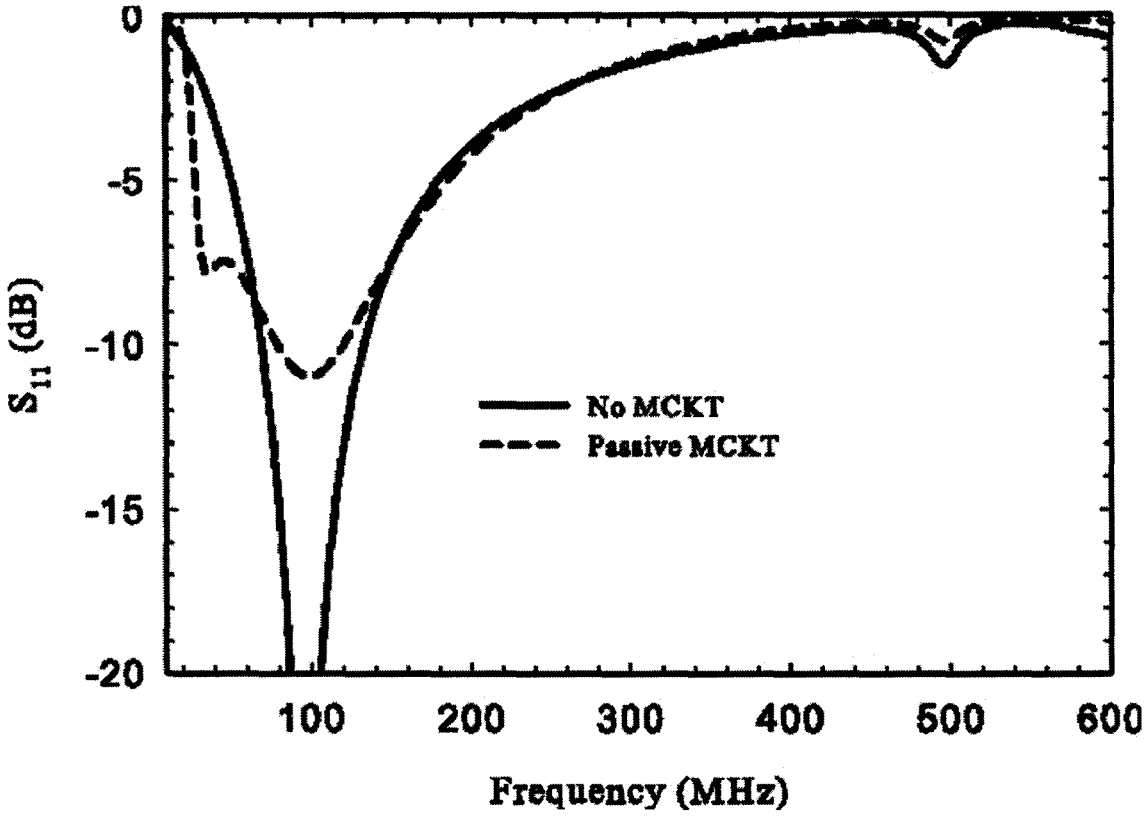
FIG. 8 is a graph of an example of the return loss $S_{11}$ of the perfectly loaded dipole antenna with and without the passive matching circuit.

The loaded antenna return loss referenced to 50Ω is shown in the example of FIG. 7. The improvement in the input impedance bandwidth using non-Foster distributed loading is clear. For a VSWR of 6:1, the unloaded antenna bandwidth is 1.25:1, while the perfectly loaded case results in a bandwidth of 5.95:1. The antenna bandwidth may of course be enhanced further by using a matching circuit placed at the feed port. The improved input impedance of 9.14:1 is shown in the example of FIG. 8 when a seventh-order passive ladder matching circuit is used at the feed port of the perfectly loaded dipole.

Figure 12:
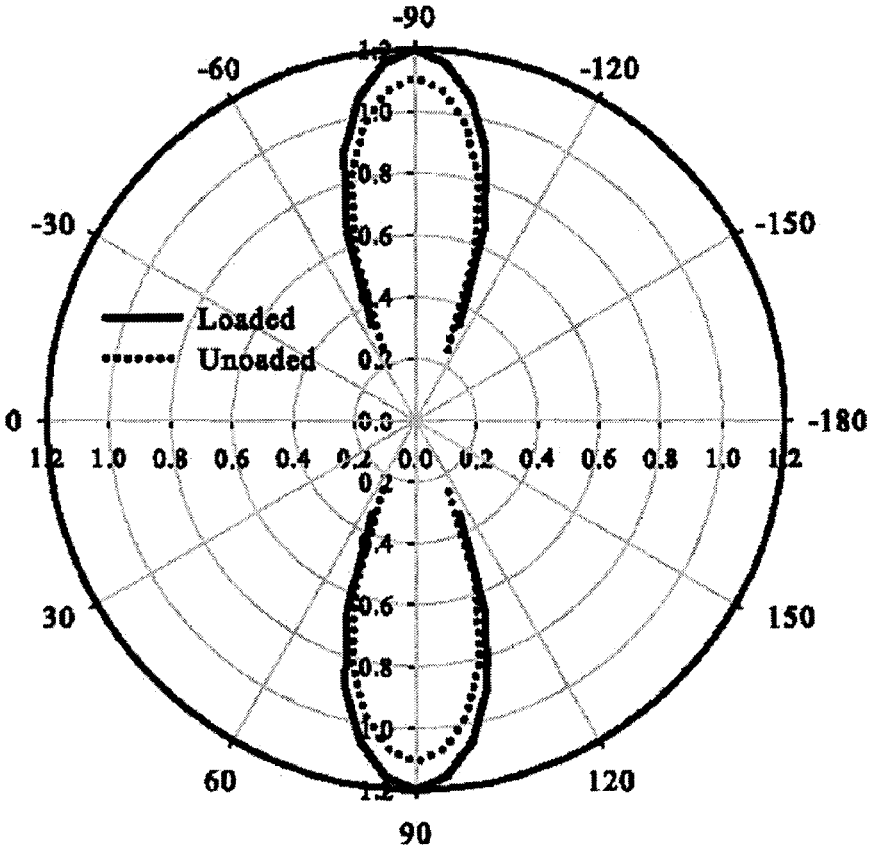
FIG. 12 is a graph of an example of the gain in dB at 10 MHz of the perfectly loaded dipole antenna compared to the unloaded antenna (excluding mismatch losses).
Figure 13:
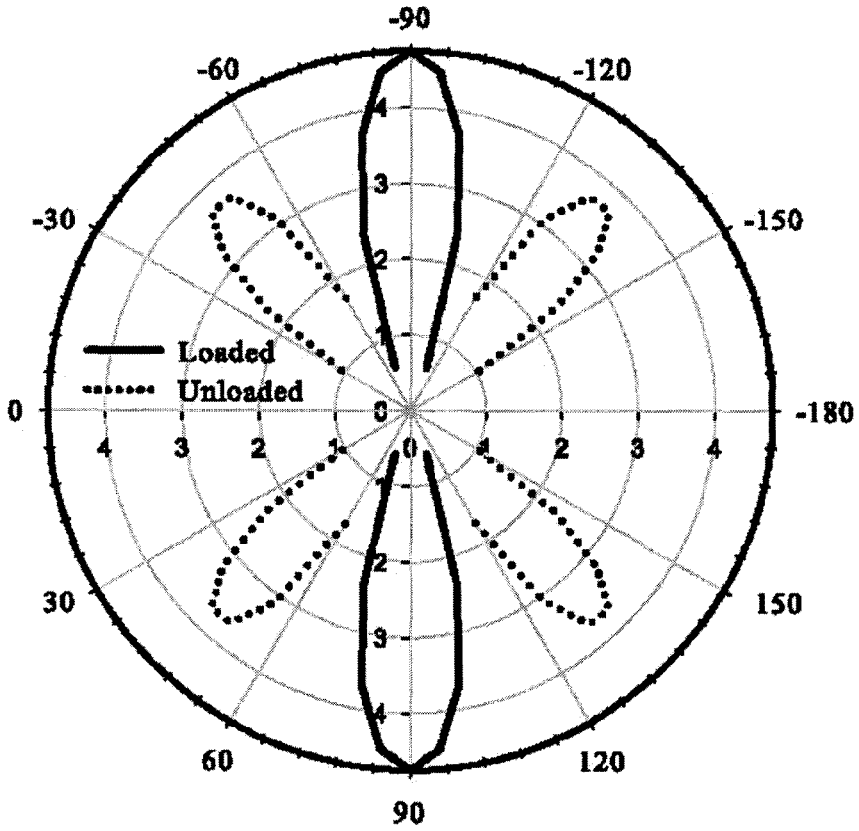
FIG. 13 is a graph of an example of the gain in dB at 400 MHz of the perfectly loaded dipole antenna compared to the unloaded antenna (excluding mismatch losses).

When discussing bandwidth, it may not be enough to describe its input impedance bandwidth, since the radiation pattern over the desired frequency band is also important. Since the dipole antenna may be loaded in such a way that it may roughly resonate a "sine wave" current shape (the first natural mode of an electrically small dipole), its radiation may be omnidirectional. FIGS. 12 and 13 illustrate the gain of an exemplary antenna at 10 MHz and 400 MHz, respectively. As far as pattern is concerned, it is obvious that loading the antenna has helped to extend the desired pattern shape seen at 10 MHz up to 400 MHz by suppressing higher order modes. Somewhere between 400 and 500 MHz, the antenna pattern degrades into the second dipole mode pattern.

Figure 9:
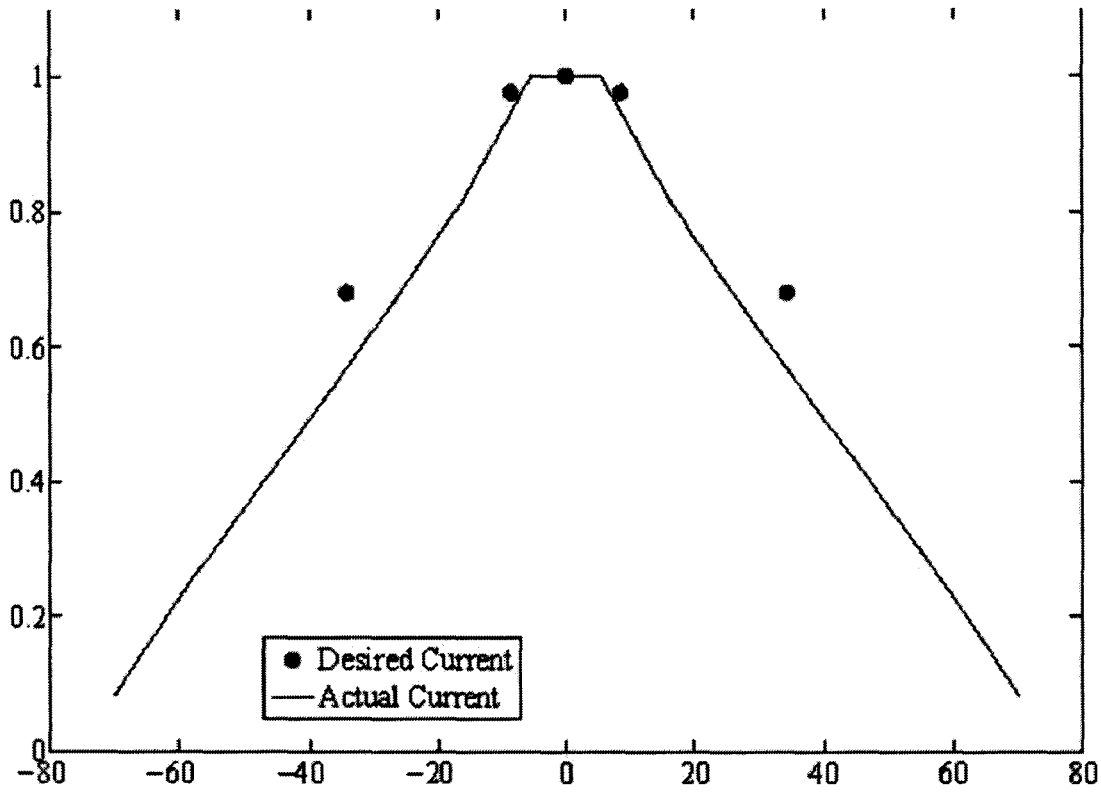
FIG. 9 is a graph of an example of a comparison of the normalized desired current distribution magnitude (dots) at 10 MHz with the normalized antenna current distribution magnitude reported by simulation (solid).
Figure 10:
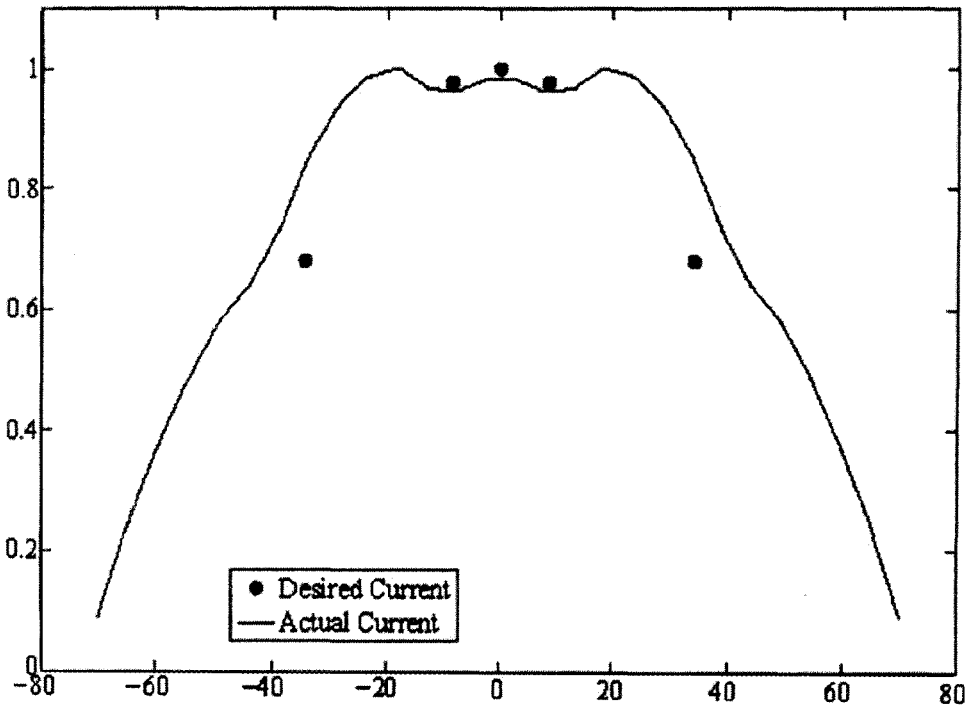
FIG. 10 is a graph of an example of a comparison of the normalized desired current distribution magnitude (dots) at 200 MHz with the normalized antenna current distribution magnitude reports by simulation (solid).
Figure 11:
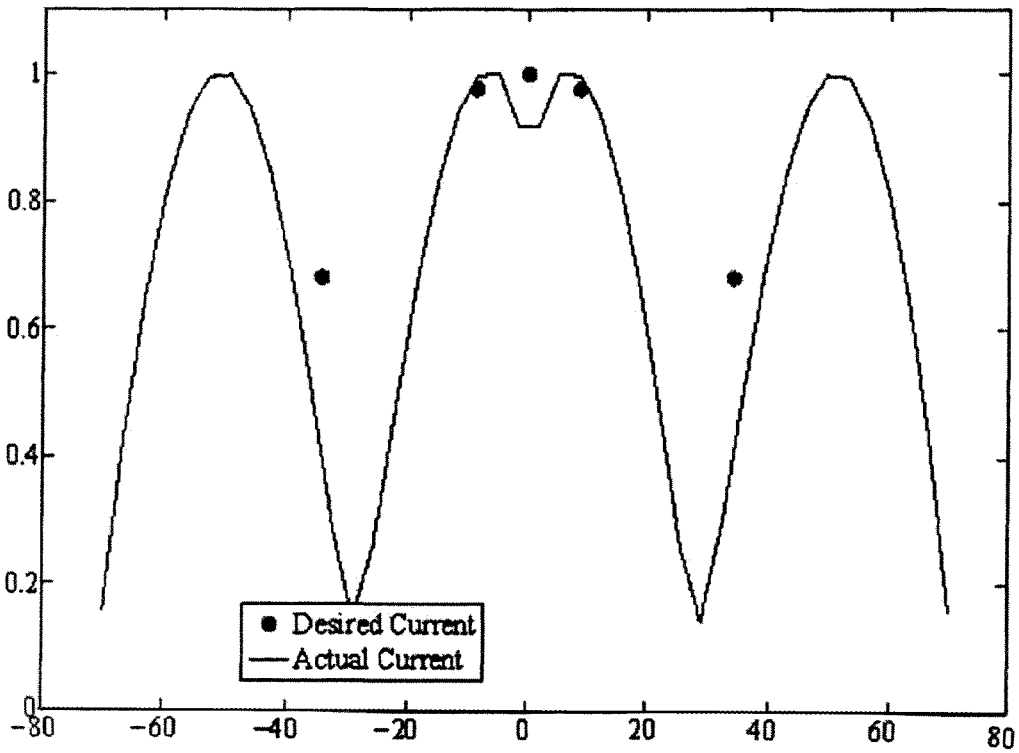
FIG. 11 is a graph of an example of a comparison of the normalized desired current distribution magnitude (dots) at 400 MHz with the normalized antenna current distribution magnitude reported by simulation (solid).

In order to better understand the effect of the loads on the actual exemplary antenna current, the normalized antenna current distribution magnitude reported by ESP5.4 was computed at 10, 200, and 400 MHz, as shown respectively in the examples of FIGS. 9 through 11. In none of the cases does the actual current distribution closely follow the desired current distribution. At the low frequency of 10 MHz (when the dipole is electrically small), the actual current distribution naturally becomes the familiar triangle. At the intermediate frequency of 200 MHz (the dipole is 1λ), the current distribution approximately follows the desired current distribution. At the high frequency of 400 MHz (when the dipole is electronically large), the actual current distribution obviously contains higher-order mode components. Interestingly, higher order modes at the high end of the frequency band degrade the input impedance performance considerably but the pattern is roughly preserved for this antenna at 400 MHz. More significantly, compared to the unloaded dipole, higher order modes on the loaded dipole have been suppressed considerably such that they do not impede antenna performance as significantly over the upper portion of its operational band. That is, higher order modes on the loaded dipole are suppressed over a wider bandwidth as compared to the unloaded dipole case. If more loading sites were added, further control over the antenna current may be possible so that the desired current distribution more closely matches the actual antenna current distribution. Equivalently, increasing the dimension of the loaded N-port $[Z]_{port}$ may allow $[Z]_{port}$ to better approximate $[Z]_{mom}$, the generalized impedance matrix generated by the method of moments. If $[Z]_{port}$ is more representative of $[Z]_{mom}$, then any current distribution resonated by $[Z]_{port}$ using this non-Foster distributed loading technique may cause the antenna current distribution to follow the desired current distribution more closely.

Characteristic mode theory may also be used in a variety of applications in other exemplary embodiments of the present invention. In one such example, the theory of characteristic modes may be used to analyze the input impedance and currents of a two-arm spherical antenna.

Both the input impedance and the radiation pattern of an antenna are proportional to the total current at the feeding port and on the antenna body. The total antenna body current I may be analyzed using the theory of characteristic modes with the following two equations:

$$\vec{J} = \sum_{n}^{N}\frac{\langle \vec{J}_n, \vec{E}^i\rangle}{1+j\lambda_n}\vec{J}_n \equiv \sum_{n}^{N}\alpha_n\vec{J}_n \tag{7}$$

$$[X]\bar{I}_n=\lambda_n[R]\bar{I}_n \tag{8}$$

where N is the order of the generalized impedance matrix, $\vec{J}_n$ are the characteristic mode currents (eigencurrents), $\lambda_n$ are the eigenvalues, and $\vec{E}^i$ is the incident electric field, which is proportional to the excitation voltage. Additionally, for lossless media all the $\vec{J}_n$ and $\lambda_n$ are real in this example. Using these definitions, two fundamental questions may now be addressed: how the characteristic modes determine $\vec{J}$; and, how the characteristic modes behave near resonance points of the input impedance.

To address the question of how the characteristic modes determine the antenna body current, Eq. (7) can be divided into two terms: the dot product $<\vec{J}_n, \vec{E}^i>$ term, and the $$\frac{1}{1+j\lambda_n}$$

term. From the dot product term, several observations may be made. First, the phase of the dot product may be determined solely by the phase of b. The dot product is zero for any $\vec{J}_n$ which are odd about the feed port (i.e. $\vec{J}_n=0$ at the feed port). $\vec{E}^i$ is almost zero everywhere on the body except at the feed port for a highly conductive antenna structure.

Thus, the overall phase of each summation term in Eq. (7) is determined by the magnitude of the $\lambda_n$ terms, if $\vec{E}^i$ is real. Using these observations, the characteristic mode behavior both near and away from resonance points of the input impedance may be understood.

Figure 14:
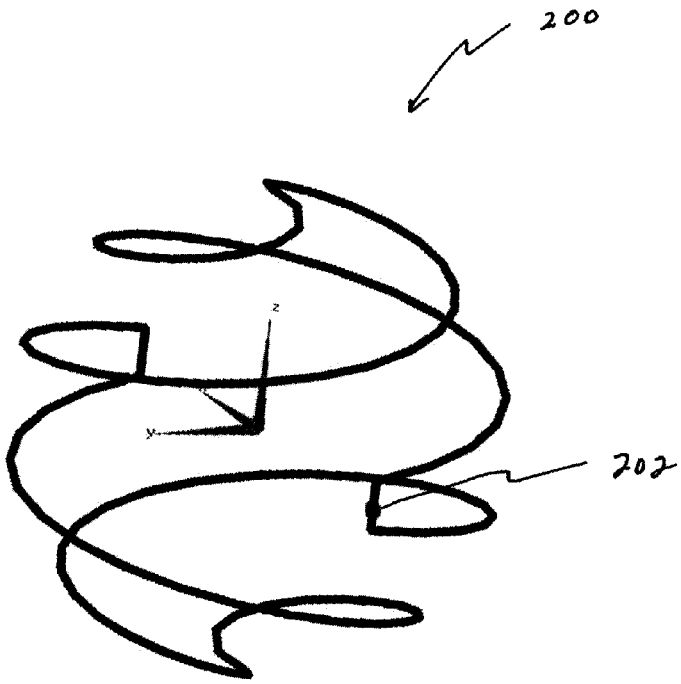
FIG. 14 is a schematic diagram of an exemplary embodiment of a 2-arm, 1-turn spherical antenna excited at a side port.

In one test, an exemplary spherical, two-arm, one-turn spiral antenna 200 having a side port 202 (FIG. 14) was simulated using ESP5 and analyzed using characteristic mode theory. Depending on the feed port location and structure, there are usually at least two primary eigencurrents (i.e., eigencurrents with the smallest $\lambda_n$ that are even around the feeding port) at a particular non-resonant frequency point. The eigenvalues $\lambda_n$ will change as a function of frequency; therefore, the magnitude and phase of $\alpha_n$ will change with frequency, determining the total current $\vec{J}$ over frequency. As the input impedance approaches a parallel resonance, there will be at least two dominant eigencurrents with nearly opposite phases at the feed point, such that the total feed current approaches zero. As the input impedance approaches a series resonance, there will be only one dominant eigencurrent, with corresponding $\lambda_n$ equal to zero. Thus, the $\alpha_n$ term will be purely real and will not change the phase of the n-th summation term.

Figure 15:
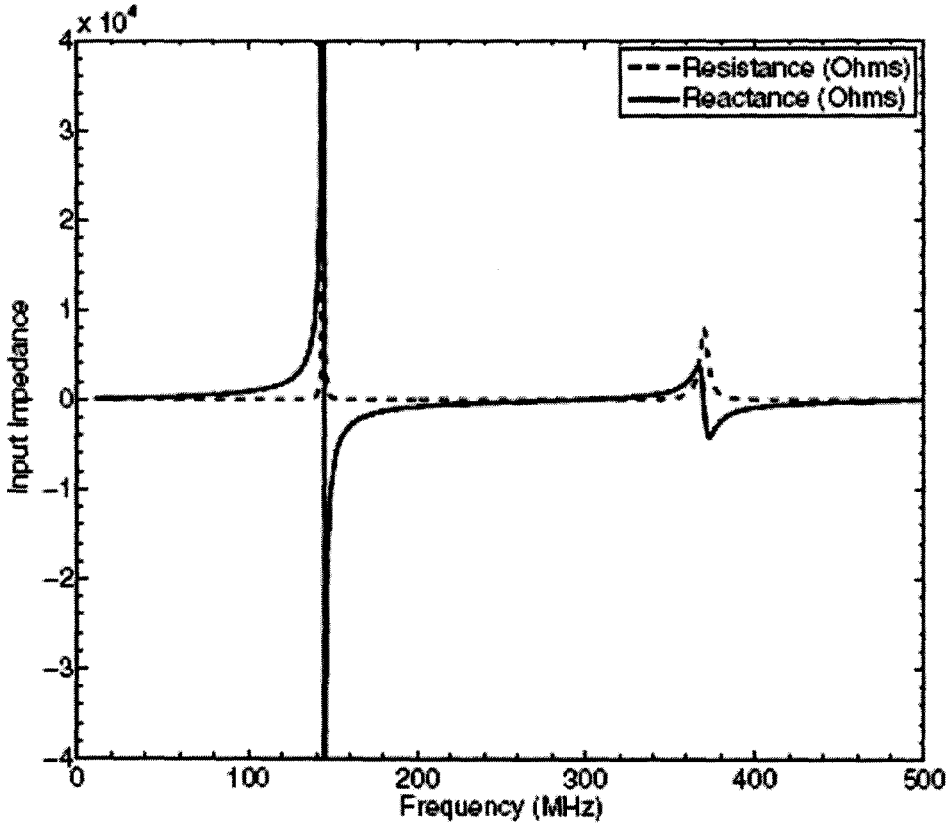
FIG. 15 is a graph of an example of a 2-arm, 1-turn spherical antenna input impedance (Reactance shown as a solid line).
Figure 16A:
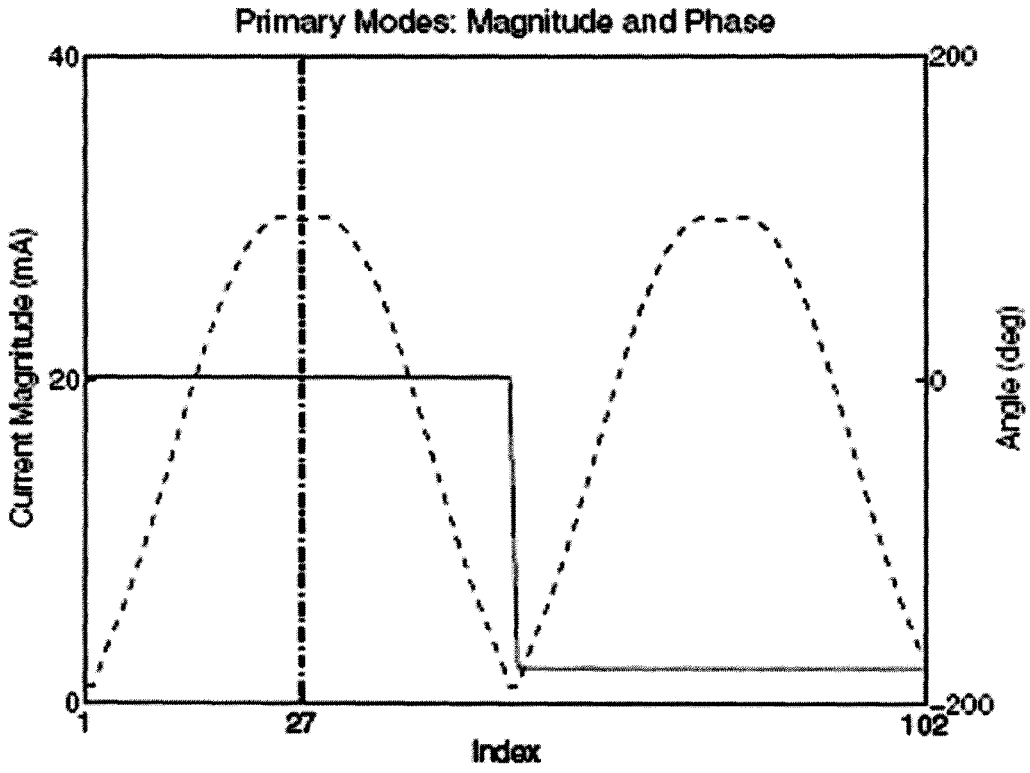
FIGS. 16(*a*) through 16(*g*) are graphs of examples of mode currents. Dashed line is current magnitude (mA), solid line is phase (degrees), and vertical dotted line indicates feed point.
Figure 16B:
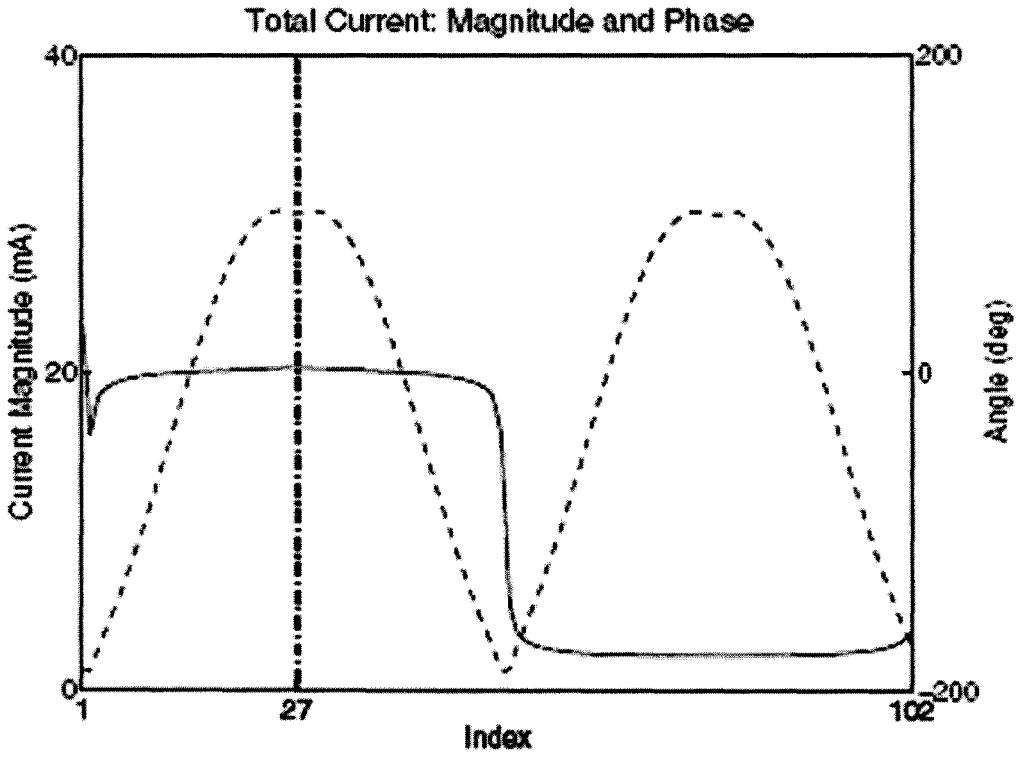
Figure 16C:
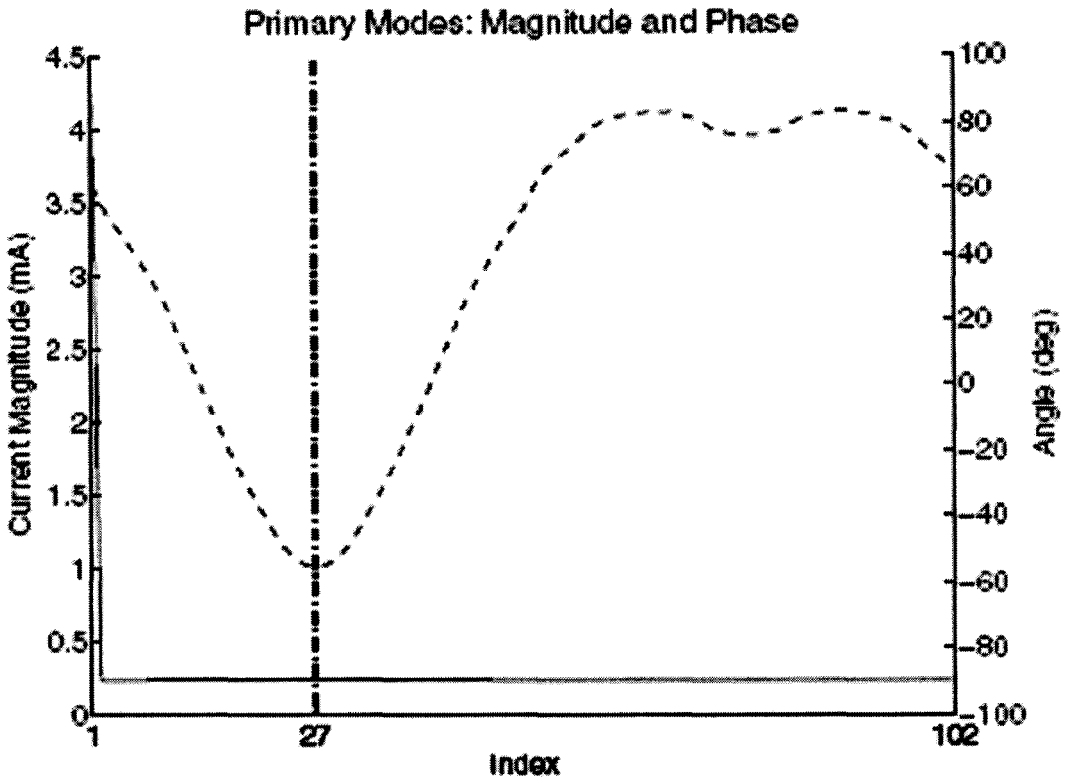
Figure 16D:
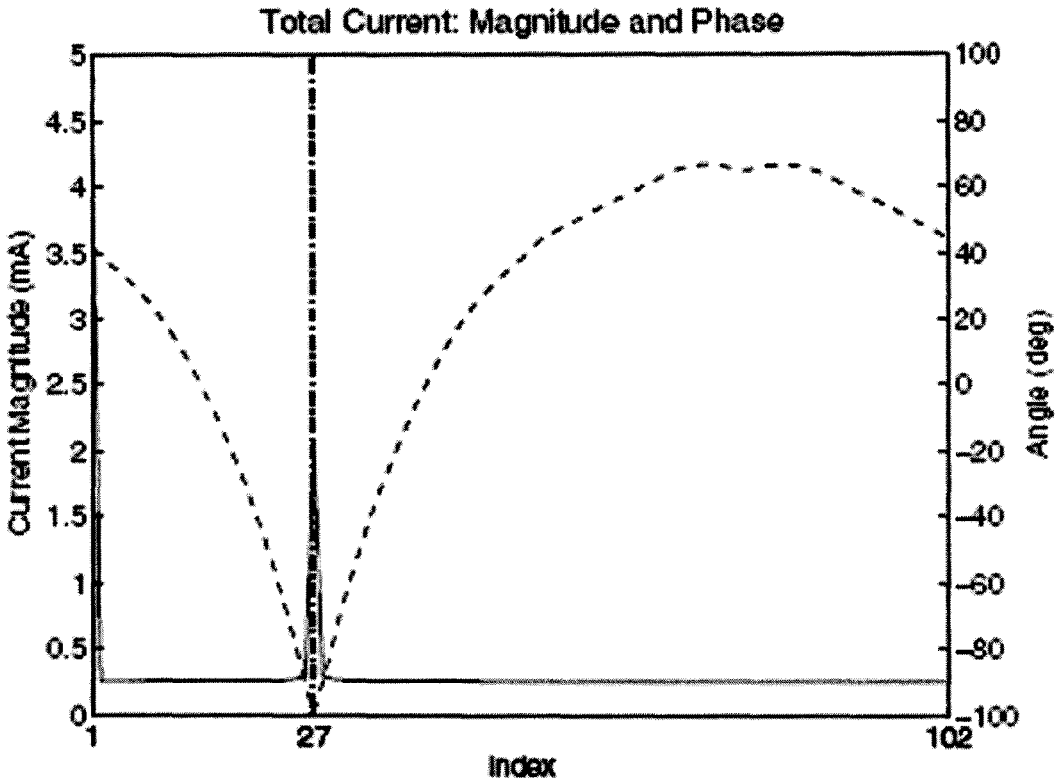
Figure 16E:
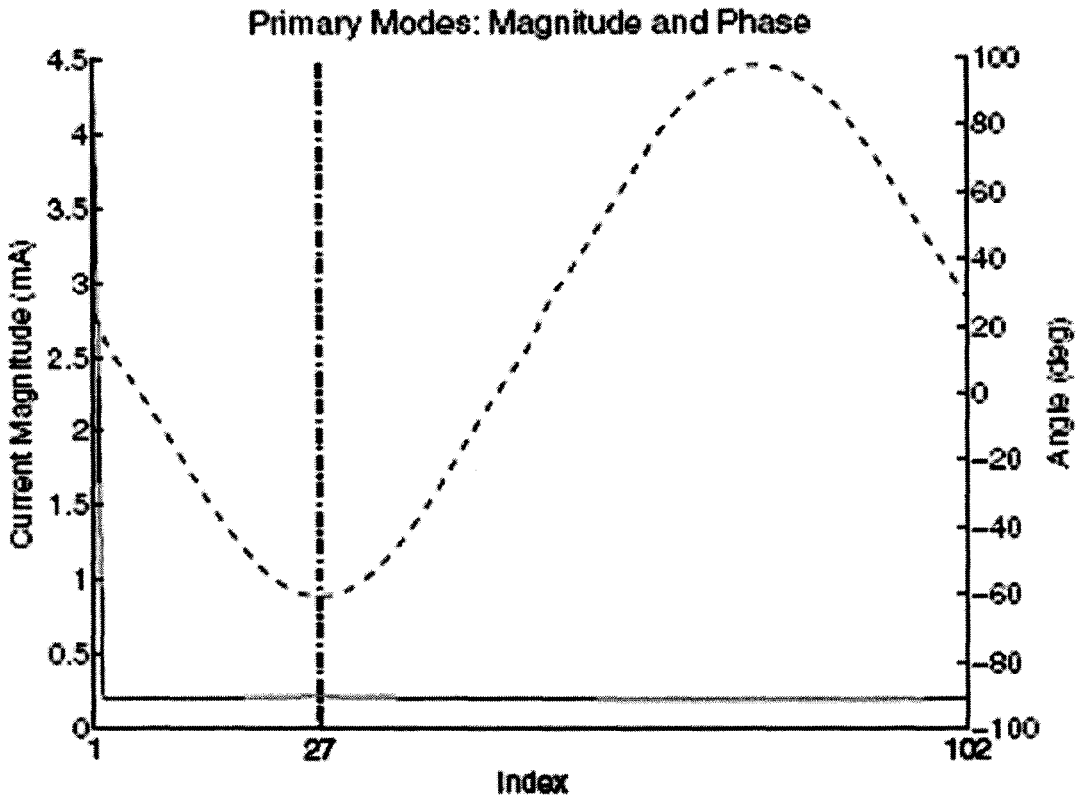
Figure 16F:
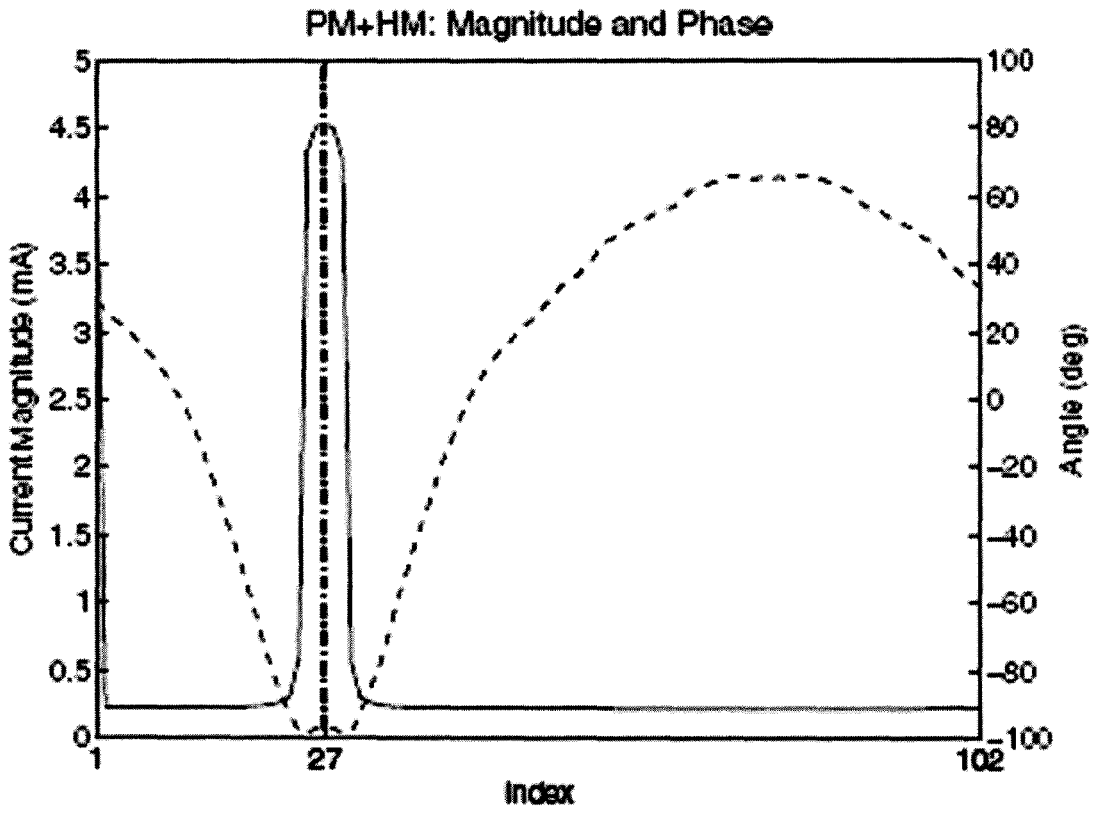
Figure 16:
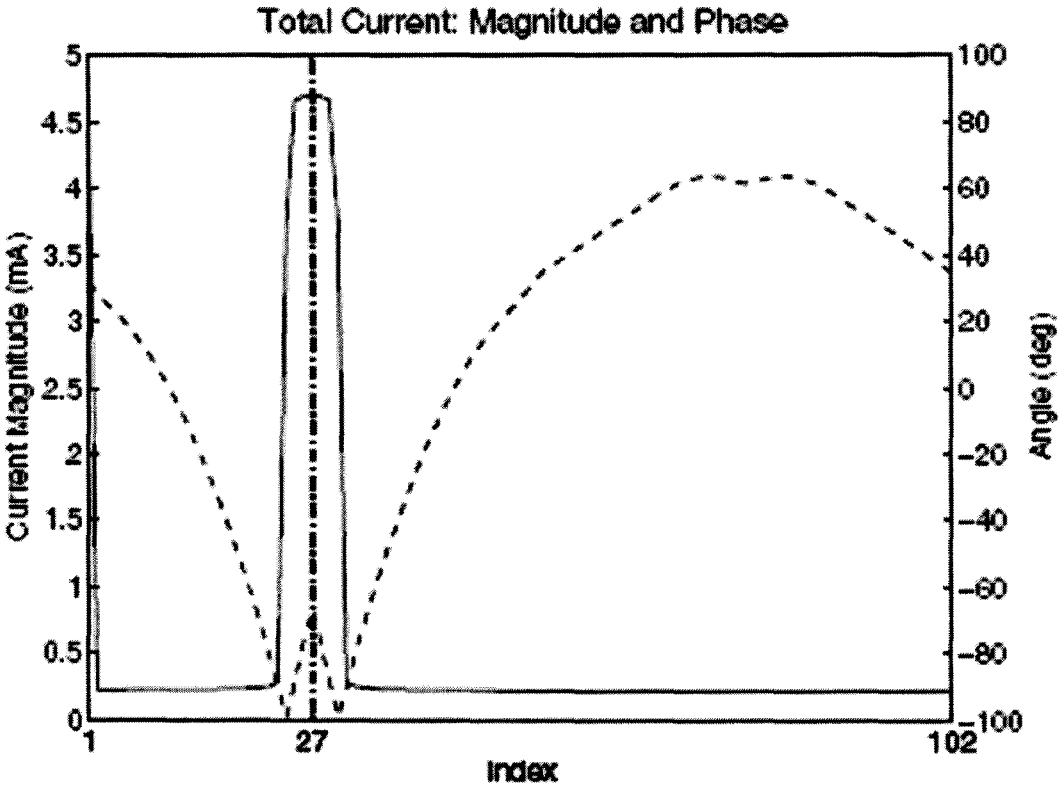

The imaginary and the real parts of the input impedance, as shown in FIG. 15, show that a series resonance occurs at 295 MHz. As shown in FIGS. 16(*a*) and 16(*b*), the series resonance has only one dominant mode with zero phase everywhere on the sphere (i.e., the total current and dominant current are nearly the same).

At the non-resonant frequency point of 160 MHz, there are two dominant modes with opposite phase, such that their summation is very small, as illustrated in FIG. 16(*e*). As may be observed from the figure, the two dominant modes are also at a minimum at the feed point; therefore, higher order modes (specifically, three modes in this case) will significantly influence the total current at this minimum, as illustrated in FIG. 16(*f*). In a similar way, at the parallel resonance point of 143 MHz, the next smallest $\lambda_n$ (after the two dominant $\lambda_n$ values) will bring the total current to almost zero (see FIGS. 16(*c*) and 16(*d*)). As the current magnitude approaches zero, potentially any of the remaining higher order modes will dominate the phase of the total current around the feed point. Thus, the phase will rapidly change (in this case, from approximately −80 degrees to 80 degrees) as the feed current magnitude diminishes. Note that the large spike in the input resistance at parallel resonance is due to the fact that the $\alpha_n$ are not exactly imaginary.

In summary, the input impedance of this exemplary embodiment of a spherical helical antenna was analyzed using the theory of characteristic modes. In particular, analysis of the series, parallel and non-resonant frequency behavior according to characteristic mode theory was performed. From the analysis, some examples for improving bandwidth may be made. In order to achieve broader bandwidths, these rapid phase changes may be suppressed; therefore, two things may be performed: (1) select a feed point such that the excited current does not diminish to zero quickly (with respect to frequency); and (2), minimize the effect of higher order modes (i.e., force the $\lambda_n$ to increase) through antenna design. In an exemplary embodiment, only one mode may dominate at a particular frequency point.

IV. CONCLUSION

In exemplary embodiments of the present invention, a scheme is introduced to design a large bandwidth antenna which is electrically small. The theory of characteristic modes is used in this scheme to determine the current distribution as well as the loads needed to resonate this current distribution over large bandwidths. In one example, the method was applied to a simple wire dipole antenna which was loaded with a set of reactive elements. It was determined that for this antenna, non-Foster reactive elements were required to synthesize the reactances determined by the diagonal matrix $[X]_L$. Furthermore, it has been demonstrated in exemplary embodiments of the present invention that through the loading of a dipole antenna using particular non-Foster elements, the overall bandwidth of the antenna may be vastly improved. Both pattern and input impedance for the dipole antenna were stable over much a wider frequency range, even without a matching network at the feed point. As expected, better input impedance bandwidth was obtained when a matching network was introduced at the feed port. With proper design, a current distribution may be resonated over a wide bandwidth in order to produce a desired pattern and impedance.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A method for designing an antenna, said method comprising:

determining a desired current distribution over an antenna;

determining a number and location of at least one port over said antenna;

determining at least one desired load to achieve said desired current distribution;

providing said at least one desired load with at least one lumped Foster or non-Foster circuit elements; and determining current and radiation patterns over a desired frequency band.

2. The method of claim 1 wherein the step of determining said desired current distribution is based on a desired radiation pattern and input impedance.

3. The method of claim 2 wherein the step of determining said desired current distribution enables a substantially constant radiation pattern and input impedance over a wider frequency band in comparison to a conventional electrically small to mid-size antenna.

4. The method of claim 1 wherein the step of determining said number and said location of said at least one port over said antenna comprises determining said number and said location of said at least one port to sufficiently control said desired current distribution.

5. The method of claim 1 wherein the step of determining said at least one desired load to achieve said desired current distribution comprises using Characteristic Mode Theory to compute said at least one desired load sufficient to resonate said desired current distribution at said at least one port over said desired frequency band.

6. The method of claim 1 wherein the step of providing said at least one desired load with said at least one lumped Foster or non-Foster circuit elements comprises providing said at least one desired load with said at least one lumped Foster or non-Foster circuit elements over said desired frequency band.

7. The method of claim 1 wherein the step of determining said current and said radiation patterns over said desired frequency band comprises determining input impedance over said desired frequency band.

8. The method of claim 1 further comprising the step of modifying said number and said location of said at least one load until said desired current and radiation patterns are achieved.

9. The method of claim 8 wherein the step of modifying said number and said location of said at least one load until said desired current and radiation patterns are achieved comprises the steps of adjusting said number and said location of said at least one port and repeating the following steps until said desired current and radiation patterns are achieved:

determining said at least one desired load to achieve said desired current distribution;

providing said at least one load with said at least one lumped Foster or non-Foster circuit elements; and determining said current and radiation patterns over said desired frequency band.

10. A method for designing an antenna, said method comprising:

determining a desired current distribution over an antenna based on at least one of a desired radiation pattern and input impedance;

determining a number and location of at least one port over said antenna to sufficiently control said desired current distribution;

determining at least one desired load to achieve said desired current distribution by using Characteristic Mode Theory to compute said at least one desired load sufficient to resonate said desired current distribution at said at least one port over said desired frequency band;

providing said at least one desired load with at least one lumped Foster or non-Foster circuit elements over said desired frequency band; and determining input impedance and current and radiation patterns over said desired frequency band.

11. The method of claim 10 wherein the step of determining said desired current distribution enables a substantially constant radiation pattern and input impedance over a wider frequency in comparison to a conventional electrically small to mid-size antenna.

12. The method of claim 10 further comprising the step of modifying said number and said location of said at least one load until said desired current and radiation patterns are achieved.

13. The method of claim 12 wherein the step of modifying said number and said location of said at least one load until said desired current and radiation patterns are achieved comprises the steps of adjusting said number and said location of said at least one port and repeating the following steps until said desired current and radiation patterns are achieved:

determining said at least one desired load to achieve said desired current distribution;

providing said at least one load with said at least one lumped Foster or non-Foster circuit elements; and determining said current and radiation patterns over said desired frequency band.

14. An antenna comprising:

a plurality of ports distributed over the antenna; and a plurality of loads distributed over the antenna, each with at least one lumped Foster or non-Foster circuit elements;

wherein said antenna is configured to enable wideband distributed control of current distribution over the antenna.

15. The antenna of claim 14 wherein said antenna is a wideband antenna.

16. The antenna of claim 15 wherein said antenna is in a size range of electrically small to mid-size.

17. The antenna of claim 14 wherein said antenna is adapted to provide a substantially constant radiation pattern and input impedance over a wide frequency band.

18. The antenna of claim 14 wherein said antenna is a dipole.

19. The antenna of claim 14 wherein:

a feed port is one of said ports; and one of said loads is located at said feed port.

20. The antenna of claim 19 wherein there are a plurality of said ports, each respectively loaded with one of said loads, in addition to said feed port.

21. The antenna of claim 14 further comprising a matching network at a feed port of the antenna.

* * * * *

US007898493C1

(12) EX PARTE REEXAMINATION CERTIFICATE (10546th)

United States Patent

Rojas et al.

(10) Number: US 7,898,493 C1

(45) Certificate Issued: Mar. 20, 2015

(54) IMPLEMENTATION OF ULTRA WIDE BAND (UWB) ELECTRICALLY SMALL ANTENNAS BY MEANS OF DISTRIBUTED NON FOSTER LOADING

(75) Inventors: Roberto G. Rojas, Upper Arlington, OH (US); Bryan D. Raines, Columbus, OH (US); Khaled A. Obeidat, Columbus, OH (US)

(73) Assignee: The Ohio State University, Columbus, OH (US)

Reexamination Request:
No. 90/012,214, Mar. 30, 2012

Reexamination Certificate for:

| | |
|---|---|
| Patent No.: | **7,898,493** |
| Issued: | **Mar. 1, 2011** |
| Appl. No.: | **12/139,424** |
| Filed: | **Jun. 13, 2008** |

Related U.S. Application Data

(60) Provisional application No. 60/943,776, filed on Jun. 13, 2007.

(51) Int. Cl.
*H01Q 1/50* (2006.01)
*H01Q 1/36* (2006.01)

(52) U.S. Cl.
CPC ..... *H01Q 1/36* (2013.01); *H01Q 5/371* (2015.01); *H01Q 5/357* (2015.01); *H01Q 5/25* (2015.01); *H01Q 5/50* (2015.01); *H01Q 5/364* (2015.01); *H01Q 5/335* (2015.01); *H01Q 5/15* (2015.01); *H01Q 5/10* (2015.01)
USPC ..... 343/850; 343/860

(58) Field of Classification Search
None
See application file for complete search history.

(56) References Cited

To view the complete listing of prior art documents cited during the proceeding for Reexamination Control Number 90/012,214, please refer to the USPTO's public Patent Application Information Retrieval (PAIR) system under the Display References tab.

*Primary Examiner* — Margaret Rubin

(57) ABSTRACT

A method to design antennas with broadband characteristics. In an exemplary embodiment, a method comprises loading an antenna structure with multiple reactive loads. The multiple loads are synthesized by applying the theory of Characteristic Modes. Another exemplary embodiment includes an antenna adapted to have broadband characteristics. One example is a wire dipole antenna. In an exemplary embodiment, a loaded antenna may be adapted to resonate an arbitrary current over a wide frequency band. The loads may require non-Foster elements when realized. Exemplary embodiments may include the broadband characteristics of the both the input impedance at the terminal of the antenna as well as the radiation pattern.

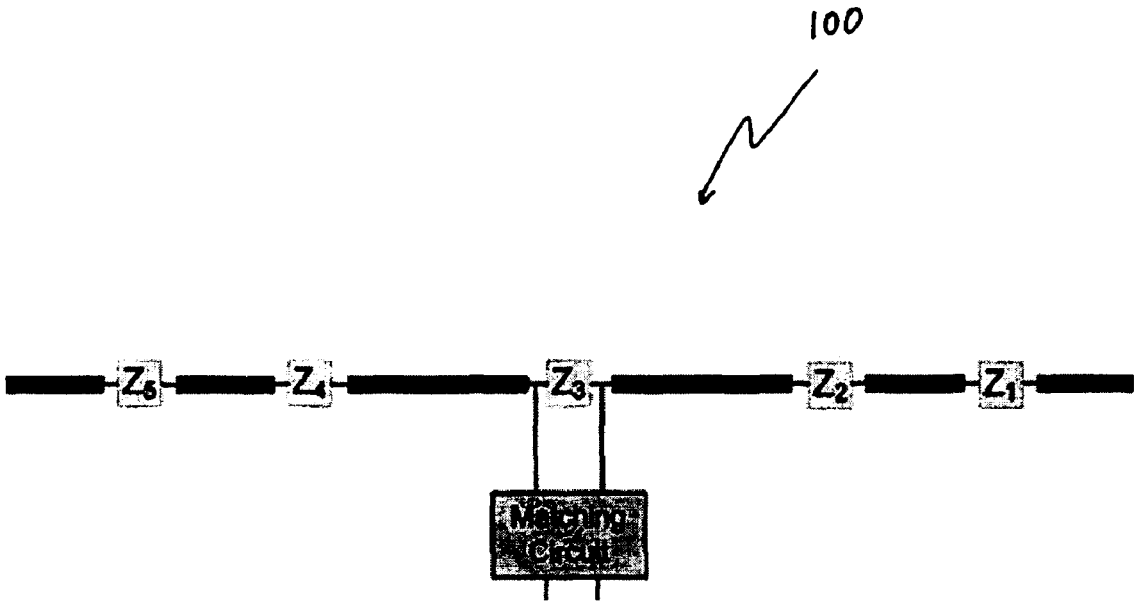

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 19 and 20 is confirmed.

Claims 1-18 and 21 are cancelled.

* * * * *